US009484679B2

(12) United States Patent
Guo et al.

(10) Patent No.: US 9,484,679 B2
(45) Date of Patent: Nov. 1, 2016

(54) ELECTRICAL CONNECTOR WITH UPPER AND LOWER TERMINALS COUPLED WITH EACH OTHER

(71) Applicant: FOXCONN INTERCONNECT TECHNOLOGY LIMITED, Grand Cayman (KY)

(72) Inventors: Bin Guo, Kunshan (CN); Chun-Ming Yu, Kunshan (CN); Guo-Hua Zhang, Kunshan (CN); Xiao-Qin Zheng, Kunshan (CN); Qi-Sheng Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/923,455

(22) Filed: Oct. 27, 2015

(65) Prior Publication Data

US 2016/0118752 A1 Apr. 28, 2016

(30) Foreign Application Priority Data

Oct. 27, 2014 (CN) ..... 2014 2 0625850 U

(51) Int. Cl.
*H01R 13/648* (2006.01)
*H01R 13/6594* (2011.01)
*H01R 12/71* (2011.01)
(Continued)

(52) U.S. Cl.
CPC ..... *H01R 13/6594* (2013.01); *H01R 12/71* (2013.01); *H01R 13/6585* (2013.01); *H01R 43/16* (2013.01)

(58) Field of Classification Search
CPC ..... H01R 9/091; H01R 12/00; H01R 12/57; H01R 12/585; H01R 12/70; H01R 12/7005; H01R 13/6585; H01R 23/725; H01R 23/7073
USPC ..... 439/78, 607.05
See application file for complete search history.

(56) References Cited

U.S. PATENT DOCUMENTS

2015/0244111 A1* 8/2015 Ju ..... H01R 13/6585 439/607.05
2016/0056586 A1* 2/2016 Guo ..... H01R 13/41 439/607.05
2016/0104975 A1* 4/2016 Guo ..... H01R 43/16 439/607.05

(Continued)

FOREIGN PATENT DOCUMENTS

CN 102456990 A 5/2012
CN 203445352 U 2/2014

(Continued)

*Primary Examiner* — Chandrika Prasad
(74) *Attorney, Agent, or Firm* — Wei Te Chung; Ming Chieh Chang

(57) ABSTRACT

An electrical connector for mounting to a printed circuit board for mating with a plug connector, includes an insulative housing and the upper and lower contacts on the housing, each contact including a contacting section, the contacts including grounding contacts each having a free end of the contacting section, and a mounting leg mounted to the corresponding grounding region of the printed circuit board wherein the free ends of the corresponding paired upper grounding contact and lower grounding contact either abut against each other or against a metallic shielding plate embedded within the mating tongue to form a parallel relation between the paired upper grounding contact and lower grounding contact.

15 Claims, 9 Drawing Sheets

(51) Int. Cl.
*H01R 43/16* (2006.01)
*H01R 13/6585* (2011.01)

(56) References Cited

U.S. PATENT DOCUMENTS

2016/0104976 A1* 4/2016 Yu ..... H01R 24/60
439/676
2016/0149349 A1* 5/2016 Kao ..... H01R 13/6585
439/607.05

FOREIGN PATENT DOCUMENTS

CN 104009338 A 8/2014
CN 104037550 A 9/2014
TW M471703 2/2014

* cited by examiner

ELECTRICAL CONNECTOR WITH UPPER AND LOWER TERMINALS COUPLED WITH EACH OTHER

BACKGROUND OF THE INVENTION

1. Field of the Invention

The present invention relates to an electrical connector, and more particularly to the electrical connector with relatively large amount of terminals for high speed transmission. This application relates to the copending application having the same filing date, the same applicant and commonly inventors therewith, and titled "ELECTRICAL CONNECTOR HAVING POWER TERMINALS".

2. Description of Related Art

USB (Universal Serial Bus) committee announced the Type C connector specification on Aug. 11, 2014 wherein the Type C plug connector may be mated with the corresponding Type C receptacle connector in a flippable manner without the specific orientation Anyhow, the crosstalk problem due to the relatively higher resonant point may affect the differential pair contacts, thus jeopardizing the transmission speed.

Hence, a simple structure of the receptacle connector to overcome the this shortcoming is desired.

SUMMARY OF THE INVENTION

Accordingly, the object of the present invention is to provide a receptacle connector with the relatively lower resonant point and crosstalk. According to the invention, an electrical connector for mounting to a printed circuit board for mating with a plug connector, includes an insulative housing and the upper and lower contacts on the housing, each contact including a contacting section, the contacts including grounding contacts each having a free end of the contacting section, and a mounting leg mounted to the corresponding grounding region of the printed circuit board wherein the free ends of the corresponding paired upper grounding contact and lower grounding contact abut against each other to form a parallel relation between the paired upper grounding contact and lower grounding contact.

Furthermore, the housing forms a front mating tongue and the rear main body, said mating tongue forming opposite surfaces with the contacting sections of the upper contacts and the lower contacts exposed thereon. The root of the mating tongue around the main body forms a step portion with a grounding collar thereon. A metallic shield is attached upon the main body to enclose the mating tongue including the step portion to form a mating cavity. The free end of the contacting section of the upper grounding contact is bent downwardly to form a first bent section with a first extension at the front end thereof; the free end of the contacting section of the lower grounding contact is bent upwardly to form a second bent section with a second extension at the front end thereof. Notably, the upper contacts and the lower contacts further include differential pair contacts, for signal transmission, located beside the grounding contacts.

In a preferred embodiment, the housing forms the upper and lower passageways for respectively receiving the corresponding upper contacts and lower contacts wherein the mating tongue further includes through holes to receive the free ends of the contacting sections of the corresponding grounding contacts so as to have the aforementioned first extension and second extension contact approach each other. The housing further is equipped with a metallic shielding plate located between the upper passageways and the lower passageways so as to have the first extension abut against an upper surface of the shielding plate and the second extension abut against a lower surface of the shielding plate. On the other hand, the outermost upper grounding contact and lower grounding contact further respectively include the third extension and the fourth extension respectively abutting against the corresponding upper surface and lower surface of the corresponding protrusion of the shielding plate.

The contacts further includes power contacts wherein free end of the contacting section of the upper power contact and a free end of the contacting section of the lower grounding contact directly abutting against each other in a cutout formed in the shielding plate.

Compared with the prior art, the free ends of the contacting sections of the paired upper and lower grounding contacts either abut against the shielding plate or directly abut against each other so as to form a parallel relation with regard to the circuits on the printed circuit board on which the connector is mounted, thus lowering the resonant point and the corresponding crosstalk of the neighboring differential pair contacts. Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
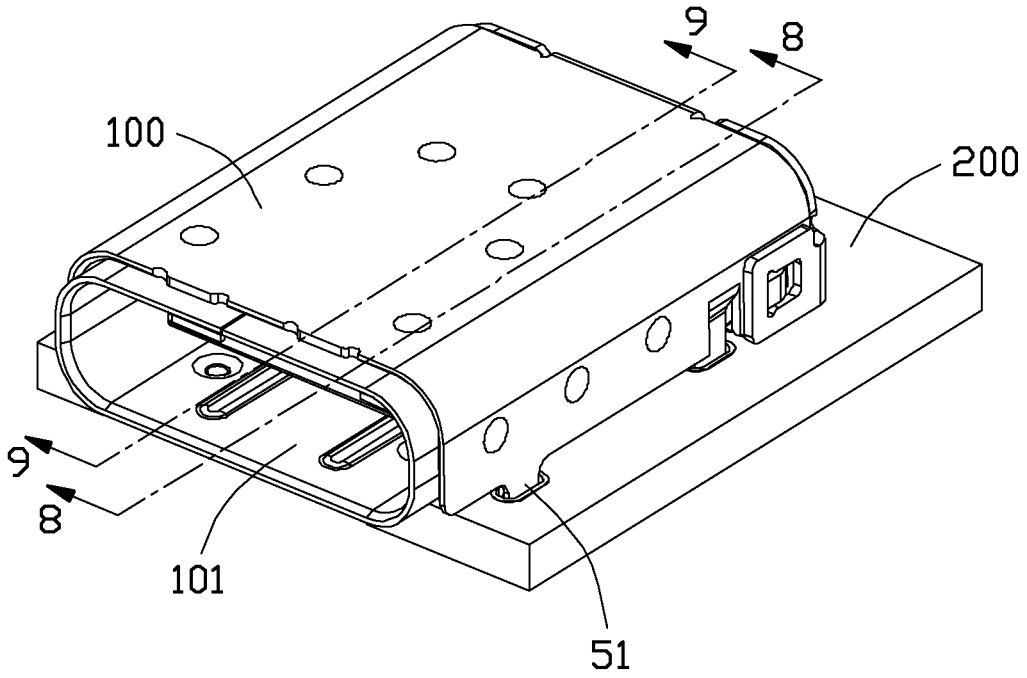
FIG. 1 is an assembled perspective view of one embodiment of the receptacle connector mounted upon the printed circuit board according to the invention.
Figure 2:
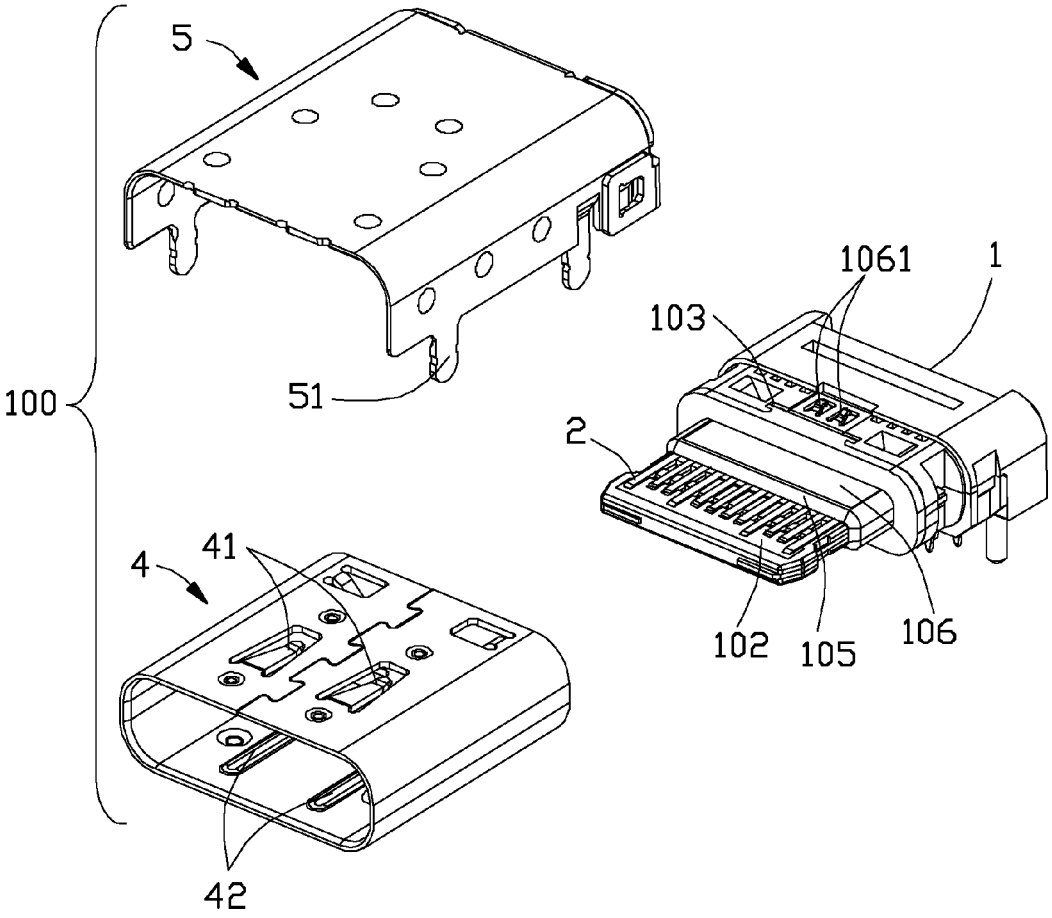
FIG. 2 is an exploded perspective view of the receptacle connector of FIG. 1.
Figure 3:
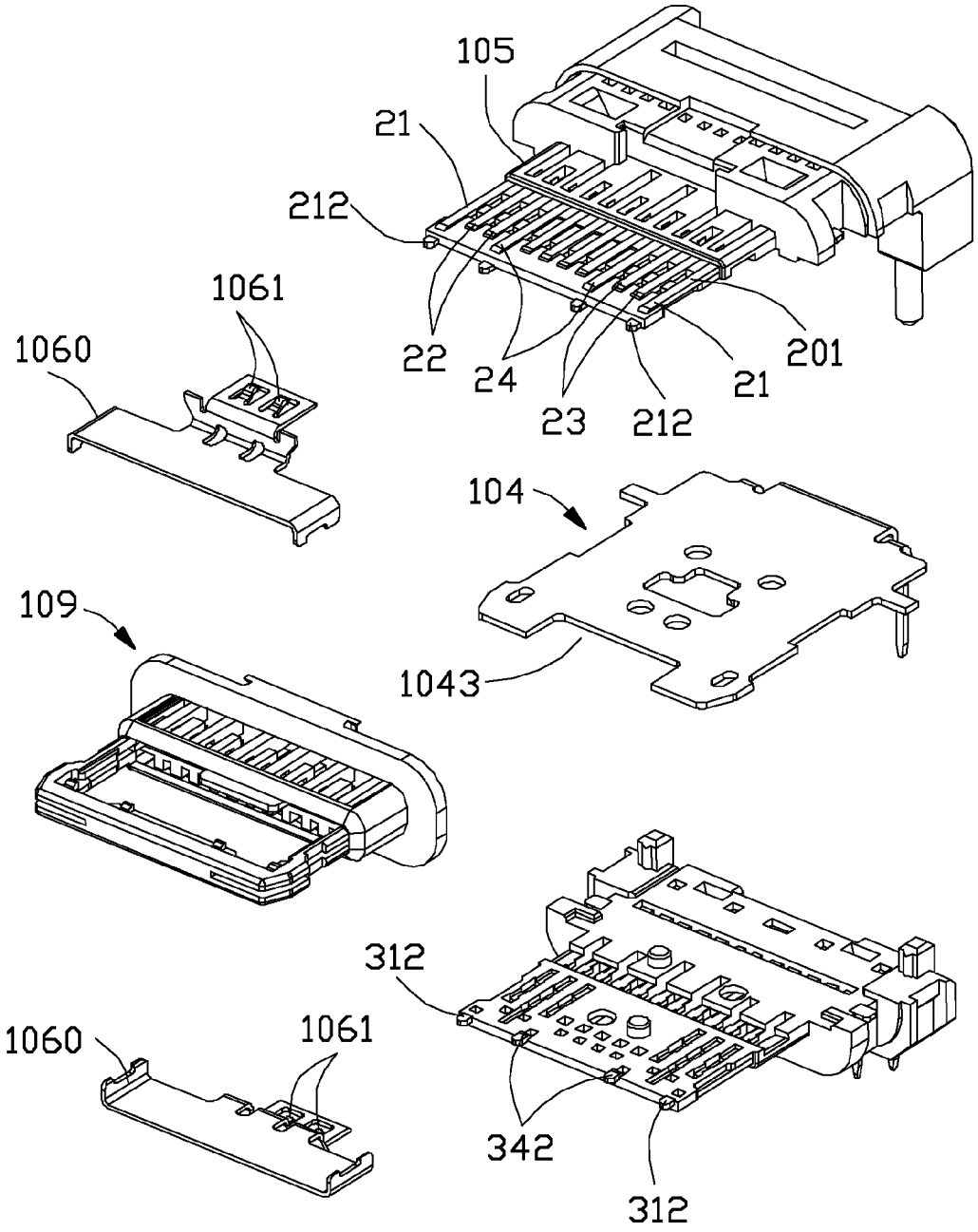
FIG. 3 is a further exploded perspective view of the receptacle connector of FIG. 2.
Figure 4:
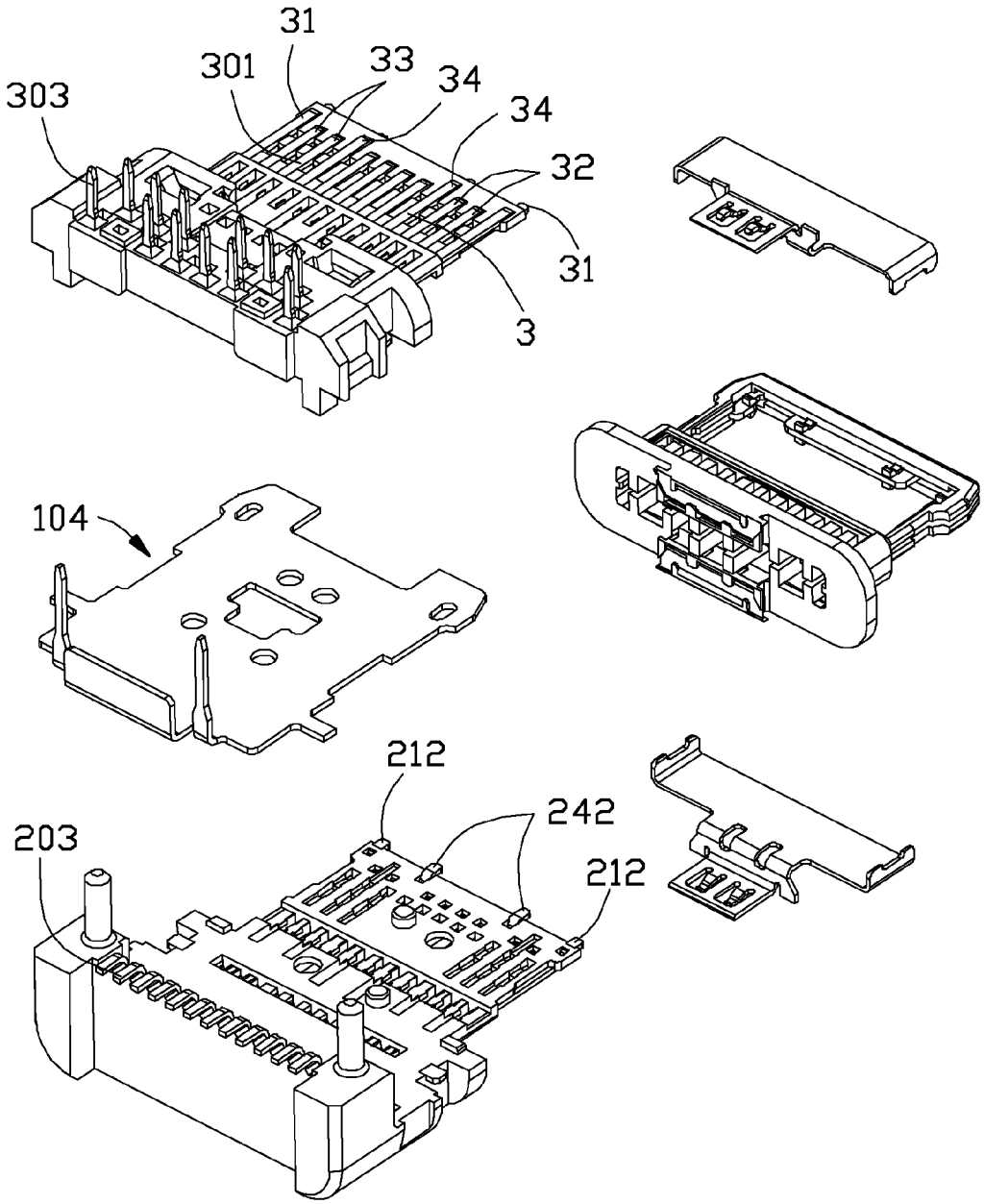
FIG. 4 is another further exploded perspective view of the receptacle connector of FIG. 2.
Figure 5:
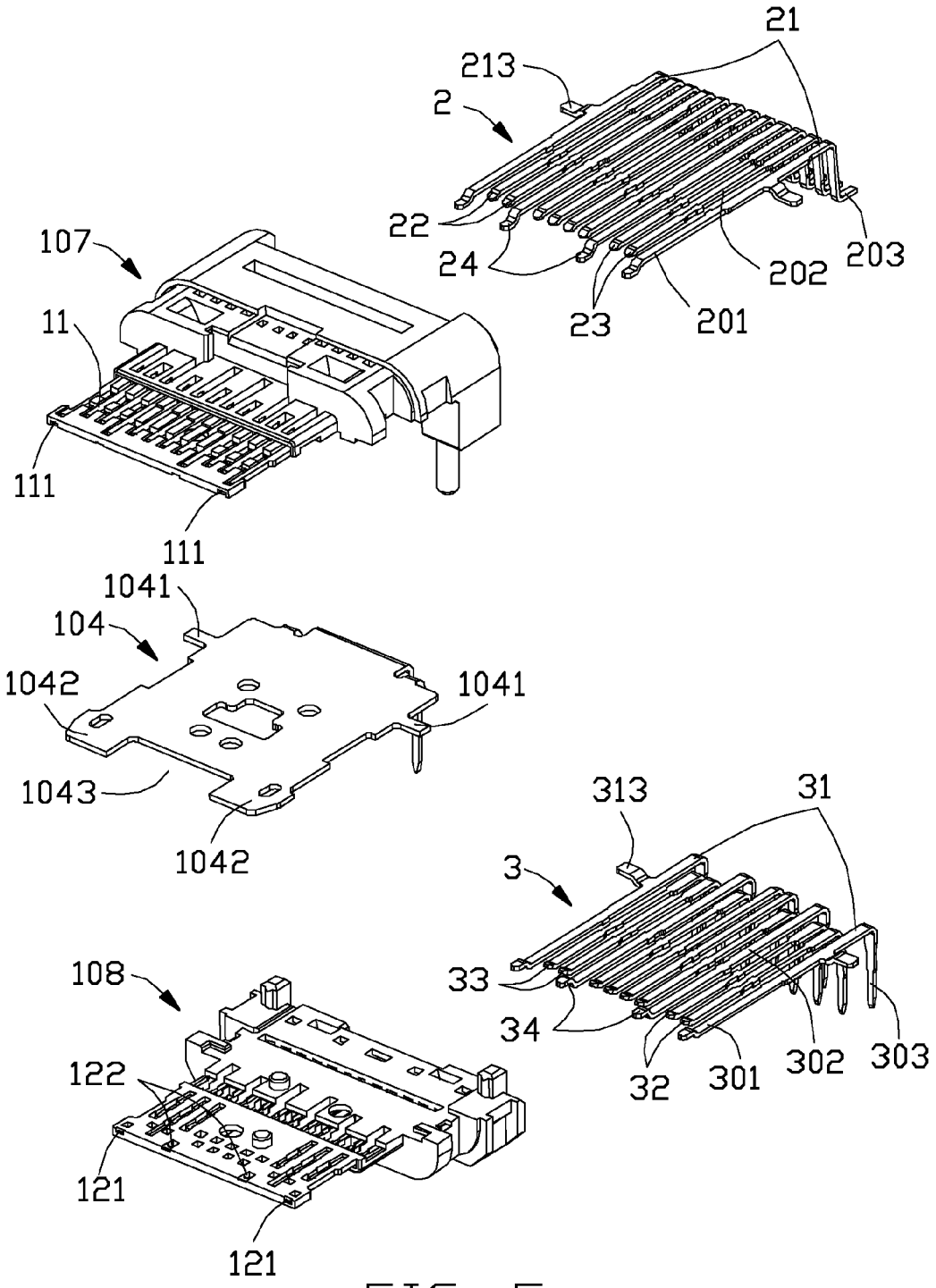
FIG. 5 is a further exploded perspective view of the receptacle connector of FIG. 3.
Figure 6:
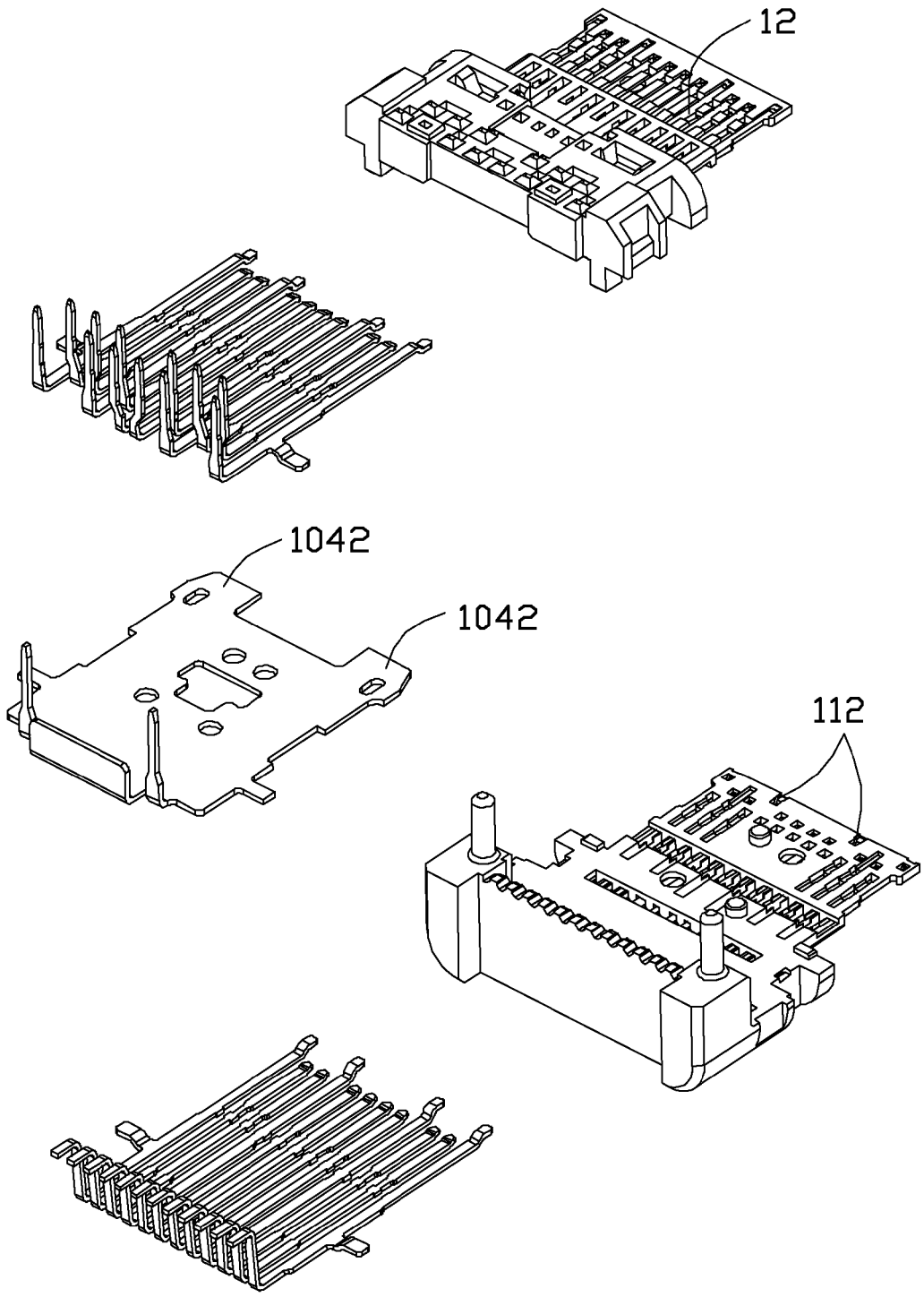
FIG. 6 is another further exploded perspective view of the receptacle connector of FIG. 4.
Figure 7:
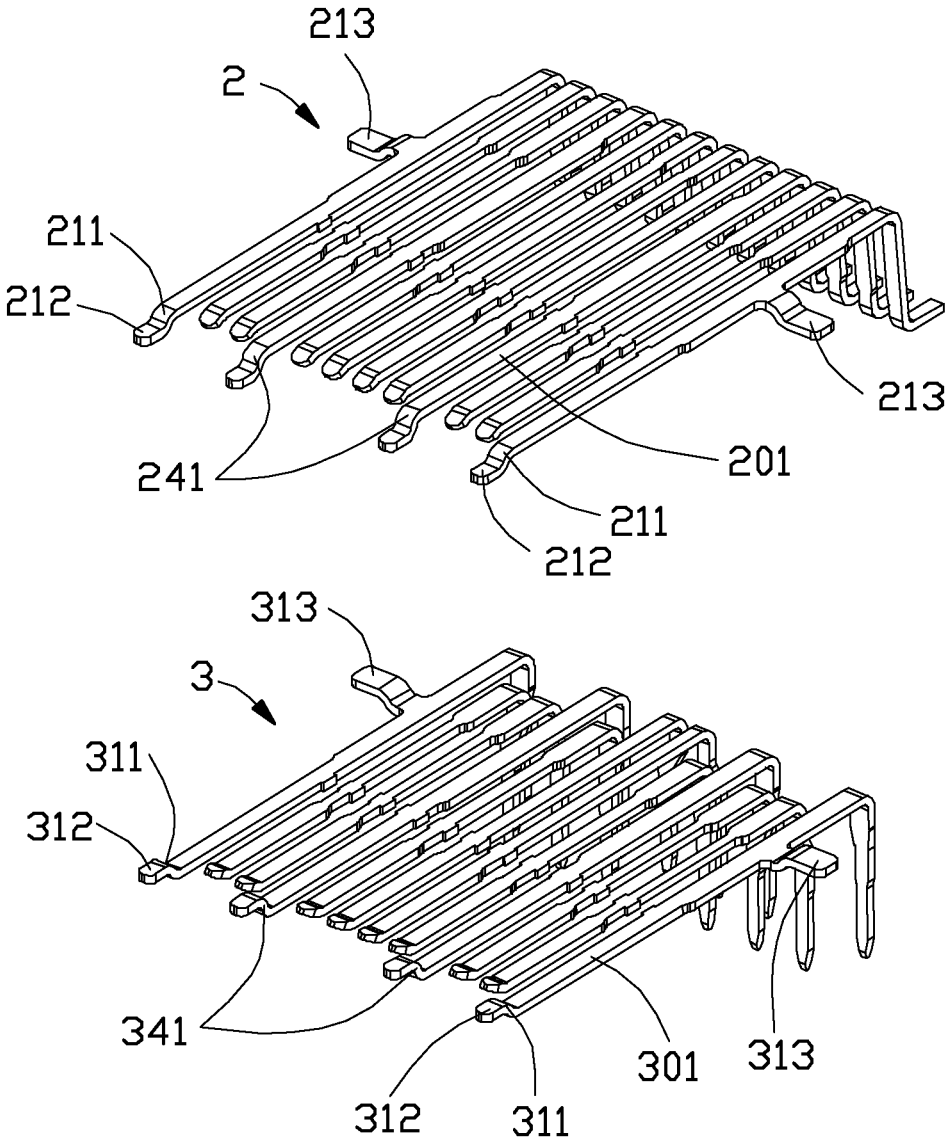
FIG. 7 is a perspective view of the contacts.
Figure 8:
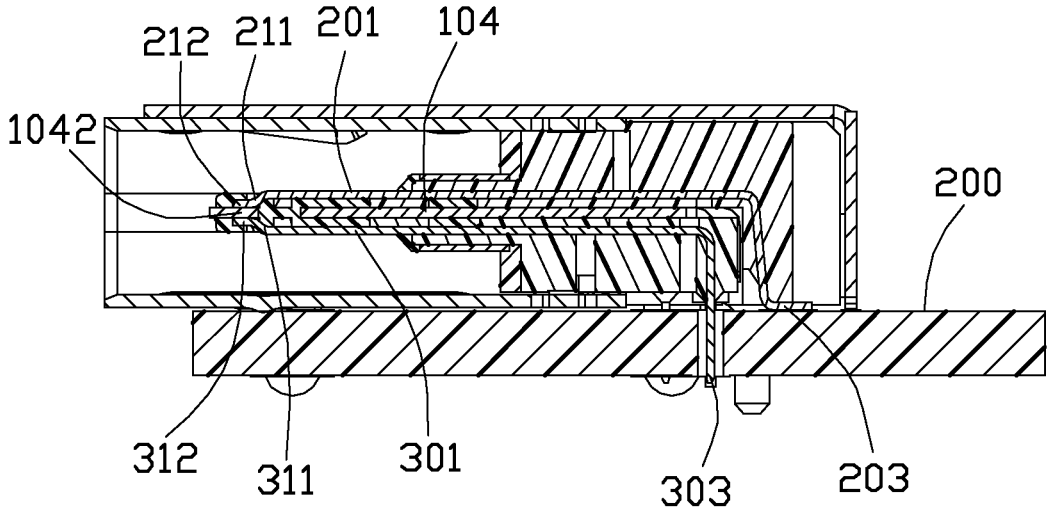
FIG. 8 is a cross-sectional view of the receptacle connector mounted upon the printed circuit board of FIG. 1.
Figure 9:
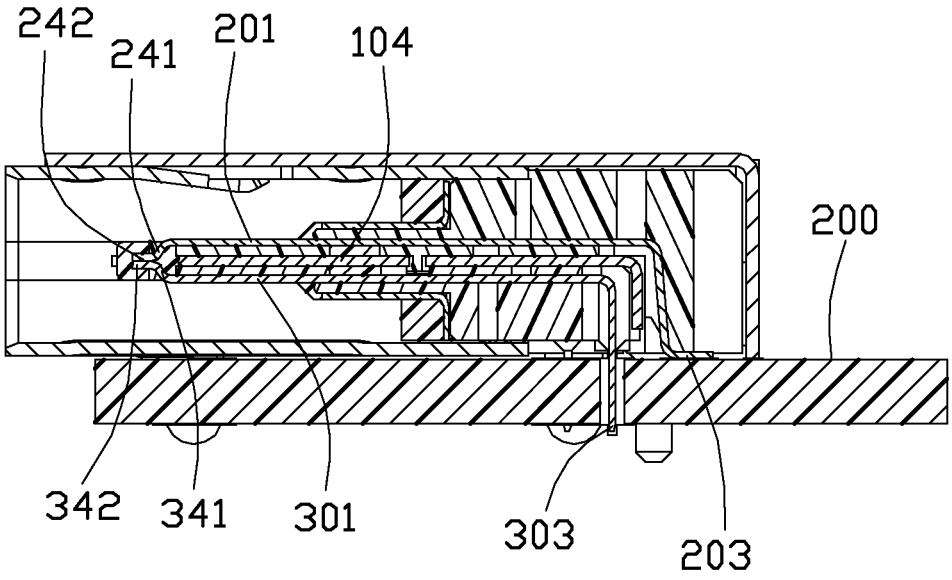
FIG. 9 is another cross-sectional view of the receptacle connector mounted upon the printed circuit board of FIG. 1.

Referring to FIGS. 1-9, a receptacle connector 100 of a first embodiment of this instant invention, includes an insulative housing 1, upper contacts 2 and lower contacts 3 mounted to the housing 1, and a metallic shield 4 enclosing the housing 1, and a metallic bracket 5 attached upon the shield 4.

Each of the upper contacts 2 includes the contacting section 201, the mounting leg/section 203 and the middle section 202 therebetween. Similarly, each of the lower contacts 3 includes the contacting section 301, the mounting leg/section 303 and the middle section 302 therebetween. The upper contacts 2 include the grounding contacts 21 and the differential pair contacts 22 adjacent thereto for signal transmission and another differential pair contacts 23 adjacent thereto for signal receiving. Similarly, the lower contacts 3 include the grounding contacts 31 and the differential pair contacts 32 adjacent thereto for signal transmission and another differential pair contacts 33 adjacent thereto for signal receiving. The upper grounding contact 21 and the lower grounding contact 31 are mechanically and electrically connected to each other. The free end of the contacting section 201 of the upper grounding contact 21 forms a first bent section 211 with a first extension 212 at the front end, and the free end of the contacting section 201 of the lower grounding contact 31 forms a second bent section 311 with a second extension 312 at the front end.

The housing 1 includes a front mating tongue 102 and a rear main body 103. The contacting sections 201 of the upper contacts 2 and the contacting sections 301 of the lower contacts 3 are exposed upon the opposite upper and lower surfaces of the mating tongue 102. A root of the mating tongue 102 forms a step portion 105 with the middle sections 202 and the middle section 302 are embedded therein. A metallic shielding plate 104 is embedded within the mating tongue 102.

The housing 1 can be categorized with the upper insulator 107, the lower insulator 108 with a middle insulator 109. A plurality of upper passageways 11 and a plurality of lower passageways 12 are formed in the corresponding surfaces of the upper insulator 107 and the lower insulator 108, and the shielding plate 104 is sandwiched between the upper insulator 107 and the lower insulator 108. In this embodiment, the upper contacts 2 are insert-molded within the corresponding upper passageways 11 so as to form an upper terminal module, and the lower contacts 3 are insert-molded within the lower passageways 12 so as to form a lower terminal module. The grounding collars 106 are formed upon opposite surfaces of the step portion 105 wherein the two grounding pieces 1060 abut against the opposite surfaces of the main body 103 and form corresponding contacting tangs 1061 abutting against he shield 4. The shield 4 is fastened to the main body 103 to enclose both the mating tongue 102 and the step portion 105 to form a mating cavity 101. The shield 4 forms spring tangs 41 and ribs 42 extending along the mating direction. The bracket 5 is welded upon the shield 4 and includes mounting legs 51 for mounting to the printed circuit board 200.

The upper insulator 107 and the lower insulator 108 form through holes 111, 121 so as to allow the associated first bent section 211 and first extension 212 and the associated second bent section 311 and second extension 312 to extend therethrough to be exposed in front of the front edge of the upper insulator 107 and the lower insulator 108 and further abut against the corresponding surfaces of the contacting region 1042 of the shielding plate 4. Therefore, the grounding contacts 21 and 31 are electrically connected to the shielding plate 104 via the first extension 212 and the second extension 312, and on the other hand, the mounting legs 203, 303 are mounted upon the printed circuit board 200. Thus, the parallel circuit paths are formed between the two grounding contacts 21, 31 to lower the resonant point and the crosstalk upon the neighboring differential pair contacts 22, 23, 32, 33. To assure connection reliability and improve high frequency performance, the (outermost) upper grounding contact 21 further includes a laterally/outwardly extending third extension 213 and the (outermost) lower grounding contact 31 further forms a laterally/outwardly extending fourth extension 313 respectively abutting against the corresponding protrusion 1041 on the shielding plate 104. Understandably, the more contacting points between the grounding contact 21, 31 with the shielding plate 104, the better the performance of the signal transmission.

Similarly, the power contacts 24, 34 also form the bent section 241, 341 and extensions 242, 342, and the upper insulator 107 and the lower insulator 108 form the corresponding through holes 112, 122 for allowing extension of the bent sections 241, 341 and the extensions 242, 342. On the other hand, a cutout is formed in the shielding plate 104 corresponding to the extensions 242, 342 to allow the extension s 242, 342 to abut against each other direction in the vertical direction. Understandably, similar to the grounding contacts 21, 31, the power contacts 24, 34 also form a parallel circuit path. In this embodiment, the middle insulator 109 are applied upon a combination of the upper insulator 107 with the associated upper contacts 2 via the first insert-molding process, the lower insulator 108 with the associated lower contacts 3 via the first insert-molding process, and the shielding plate 104 therebetween, by the second insert-molding process. Notably, the originally exposed first extension 212 in front of the front edge of the upper insulator 107, the originally exposed second extension 312 in front of the front edge of the lower insulator 108, the originally exposed third extension 213 beside the side edge of the upper insulator 107, and the originally exposed fourth extension 313 beside the side edge of the lower insulator 108 are protectively covered in the middle insulator 109 after the second insert-molding process. Notably, the grounding collars 106 are fastened to the step portion 105 via the second insert-molding process.

In another embodiment, the grounding contacts 21, 31 may be arranged not to abut against the shielding plate 104 but directly abutting against each other via the arrangement similar to the power contacts 24, 34, i.e., the shielding plate 104 forming a cutout corresponding to the first extension 212, the second extension 312, the third extension 213 and the fourth extension 313 to allow direct abutment between the upper grounding contact 21 and the lower grounding contact 31 in the vertical direction.

However, the disclosure is illustrative only, and changes may be made in detail, especially in matter of shape, size, and arrangement of parts within the principles of the invention.

What is claimed is:

1. A receptacle connector for engagement with a complementary plug connector and mounting to a printed circuit board, comprising:

an insulative housing defining a main body and a mating tongue forwardly extending therefrom in a front-to-back direction, said mating tongue defining opposite upper surfaces and lower surfaces in a vertical direction perpendicular to said front-to-back direction;

a plurality of contacts disposed in the housing, categorized with grounding contact, power contacts and differential pair contacts, and grouped as upper contacts and lower contacts, each of said contacts including a rear mounting section for mounting to the printed circuit board and a front contacting section exposed upon the mating tongue wherein the contacting section of the upper contact is exposed upon the upper surface and the contacting section of the lower contact is exposed upon the lower surface;

a metallic shield enclosing the housing to define a mating cavity in which the mating tongue is disposed; and a metallic shielding plate embedded within the mating tongue and including at least a mounting leg for mounting to the printed circuit board; wherein the grounding contact of the upper contacts and the grounding contact of the lower contacts are symmetrically arranged with each other in the vertical direction and respectively equipped with extensions spaced from the corresponding upper and lower surfaces in the vertical direction to be simultaneously connected with the shielding plate.

2. The receptacle connector as claimed in claim 1, wherein the extension of said grounding contact of the upper contacts and the extension of said grounding contact of the lower contacts are symmetrically arranged with each other in the vertical direction.

3. The receptacle connector as claimed in claim 1, wherein the extensions of the grounding contact of the upper contacts and the extension of the grounding contact of the lower contacts are formed at front ends of said grounding contacts proximate to a front edge of the mating tongue.

4. The receptacle connector as claimed in claim 1, wherein said grounding contacts are located at an outermost position in a transverse direction perpendicular to both said front-to-back direction and said vertical direction, and the extensions extend laterally and outwardly proximate to a side edge of the mating tongue.

5. The receptacle connector as claimed in claim 4, wherein the shielding plate forms a corresponding laterally and outwardly extending protrusion sandwiched between the extensions of said grounding contacts in the vertical direction.

6. The receptacle connector as claimed in claim 1, wherein said extension extends in the front-to-back direction.

7. The receptacle connector as claimed in claim 6, wherein the main body and the mating tongue of the housing are formed by an upper insulator, a lower insulator and a middle insulator therebetween in the vertical direction, and the upper contacts are insert-molded within the upper insulator to form an upper terminal module, the lower contacts are insert-molded within the lower insulator to form a lower terminal module, and the middle insulator is applied upon a combination of the upper terminal module and the lower terminal module.

8. The receptacle connector as claimed in claim 7, the extension of the grounding contact of the upper contacts is exposed in front of a front edge of the upper insulator while covered by the middle insulator, and the extension of the grounding contact of the lower contacts is exposed in front of a front edge of the lower insulator while covered by the middle insulator.

9. The receptacle connector as claimed in claim 7, the extension of the grounding contact of the upper contacts is exposed beside a side edge of the upper insulator while covered by the middle insulator, and the extension of the grounding contact of the lower contacts is exposed beside a side edge of the lower insulator while covered by the middle insulator.

10. A receptacle connector for engagement with a complementary plug connector and mounting to a printed circuit board, comprising:

an insulative housing defining a main body and a mating tongue forwardly extending therefrom in a front-to-back direction, said mating tongue defining opposite upper surfaces and lower surfaces in a vertical direction perpendicular to said front-to-back direction;

a plurality of contacts disposed in the housing, categorized with grounding contact, power contacts and differential pair contacts, and grouped as upper contacts and lower contacts, each of said contacts including a rear mounting section for mounting to the printed circuit board and a front contacting section exposed upon the mating tongue wherein the contacting section of the upper contact is exposed upon the upper surface and the contacting section of the lower contact is exposed upon the lower surface;

a metallic shield enclosing the housing to define a mating cavity in which the mating tongue is disposed; and a metallic shielding plate embedded within the mating tongue and including at least a mounting leg for mounting to the printed circuit board; wherein one of the upper contacts and another one of the lower contacts are symmetrically arranged with each other in the vertical direction and respectively equipped with extensions spaced from the corresponding upper and lower surfaces in the vertical direction to be mechanically and electrically connected with each other in the vertical direction.

11. The receptacle connector as claimed in claim 10, wherein the extensions are located around a front edge of the mating tongue.

12. The receptacle connector as claimed in claim 11, wherein the shielding plate forms a cutout in a front edge thereof to receive at least one of said extensions.

13. The receptacle connector as claimed in claim 10, wherein said extensions are located around a side edge of the mating tongue.

14. The receptacle connector as claimed in claim 10, wherein the main body and the mating tongue of the housing are formed by an upper insulator, a lower insulator and a middle insulator between said upper insulator and said lower insulator in the vertical direction, and the upper contacts are insert-molded within the upper insulator to form an upper terminal module, the lower contacts are insert-molded within the lower insulator to form a lower terminal module, and the middle insulator is applied upon a combination of the upper terminal module and the lower terminal module via another insert-molding process.

15. The receptacle connector as claimed in claim 14, wherein the extension of said one of the upper contacts is exposed in front of a front edge of the upper insulator while covered by the middle insulator, and the extension of said another one of the lower contacts is exposed in front of a front edge of the lower insulator while covered by the middle insulator.

* * * * *